US008899681B2

(12) United States Patent
Ko

(10) Patent No.: US 8,899,681 B2
(45) Date of Patent: Dec. 2, 2014

(54) SEAT GUIDING APPARATUS FOR CHAIR

(76) Inventor: Wen-Shan Ko, Changhua County (TW)

( * ) Notice: Subject to any disclaimer, the term of this patent is extended or adjusted under 35 U.S.C. 154(b) by 110 days.

(21) Appl. No.: 13/602,809

(22) Filed: Sep. 4, 2012

(65) Prior Publication Data

US 2013/0069406 A1 Mar. 21, 2013

(30) Foreign Application Priority Data

Sep. 20, 2011 (TW) ..... 100217611 U

(51) Int. Cl.
*A47C 3/00* (2006.01)
*A47C 1/032* (2006.01)

(52) U.S. Cl.
CPC ..... *A47C 1/03261* (2013.01); *A47C 1/03294* (2013.01); *A47C 1/03266* (2013.01); *A47C 1/03272* (2013.01)
USPC ..... 297/340; 297/302.6; 297/303.3; 297/302.3

(58) Field of Classification Search
USPC ..... 297/300.4, 300.6, 300.7, 302.3, 302.5, 297/302.6, 303.3, 301.3, 301.5, 301.6, 340
See application file for complete search history.

(56) References Cited

U.S. PATENT DOCUMENTS

| | | | | |
|---|---|---|---|---|
| 3,603,640 | A * | 9/1971 | Doerner | 297/292 |
| 4,198,094 | A * | 4/1980 | Bjerknes et al. | 297/300.4 |
| 4,796,950 | A * | 1/1989 | Mrotz et al. | 297/303.3 |
| 6,659,554 | B2 * | 12/2003 | Su | 297/301.3 |
| 7,566,097 | B2 * | 7/2009 | Sander et al. | 297/300.2 |
| 2002/0043844 | A1 * | 4/2002 | Hobb et al. | 297/302.3 |

* cited by examiner

*Primary Examiner* — Sarah B McPartlin
(74) *Attorney, Agent, or Firm* — Browdy and Neimark, PLLC

(57) ABSTRACT

A seat guiding apparatus for a chair includes a base, an elastic assembly mounted in the front end of the base and having a torsion spring and a moveable plate abutted against the torsion spring, and a seat assembly provided with a seat and a bracket connected with the seat. The bracket of the seat assembly has a front end connected with the moveable plate and a rear end movably mounted in curved guiding grooves of the base, such that the seat assembly is moveable along the curved guiding grooves relative to the base. As a result, when sitting on the seat, a sitter' back can be guided by the movement of the seat assembly to lean against a backrest of the chair for support.

4 Claims, 7 Drawing Sheets

SEAT GUIDING APPARATUS FOR CHAIR

BACKGROUND OF THE INVENTION

1. Field of the Invention

The present invention relates generally to a chair and more particularly, to a seat guiding apparatus for a chair that can enhance comfort and add support to a sitter.

2. Description of the Related Art

A convention seat of a chair is usually designed to be stationary. When sitting on the conventional seat, a sitter needs to adjust the sitting posture to allow the back against the backrest of the chair for support. However, the sitter may unconsciously remove the back from the backrest of the chair due to a change in the sitting posture, such that the sitter will feel a growing discomfort and eventually pain in the spine after sitting for a long time.

Although a seat adjustment or backrest angle adjustment device is widely used in a chair for enhancing sitting comfort, it can't ensure that the sitter's back will lean against the backrest of the chair when sitting. Therefore, it is desired to provide an improved seat for a chair.

SUMMARY OF THE INVENTION

The present invention has been accomplished in view of the above-noted circumstances. It is therefore the primary objective of the present invention to provide a seat guiding apparatus for a chair, which can automatically guide a sitter's back against a backrest of the chair for enhancing comfort and support to the sitter.

To achieve the above-mentioned objective, the seat guiding apparatus provided by the present invention comprises a base having two opposite guiding portions each extending curvedly from a rear end of the base toward a front end of the base and provided with a curved guiding groove, an elastic assembly having a shaft fastened to the front end of the base, a moveable plate pivotally connected with the shaft, and a torsion spring mounted on the shaft and provided with two distal ends abutted against a bottom of the moveable plate, and a seat assembly having a seat and a bracket connected with the seat. The bracket includes a front end connected with the moveable plate and a rear end provided with two opposite lug portions respectively connected with the guiding portions of the base through a pin inserted into each of the curved guiding grooves. By this way, when a sitter sits on the seat of the seat assembly, the seat assembly is pivotable around the shaft and movable downwards along the curved guiding grooves relative to the base for enabling the sitter's back to lean against a backrest of the chair, thereby attaining the purpose of enhancing comfort and support.

Preferably, in order to support different sitters with different weights, an elasticity adjusting assembly is provided for adjusting the torsional force of the torsion spring. The elasticity adjusting assembly includes a swivel member pivotally mounted in the base and provided with an abutting portion abutted against the torsion spring, a screw rod rotatably inserted into the base through an elongated slot of the swivel member, a knob mounted with one end of the screw rod for driving the screw rod to rotate, and a press block screwed onto the screw rod and located on the swivel member. Thus, when the press block is driven by the screw rod to press the swivel member, the swivel member is turned to push the torsion spring through its abutting portion for increasing the tension of the torsion spring.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
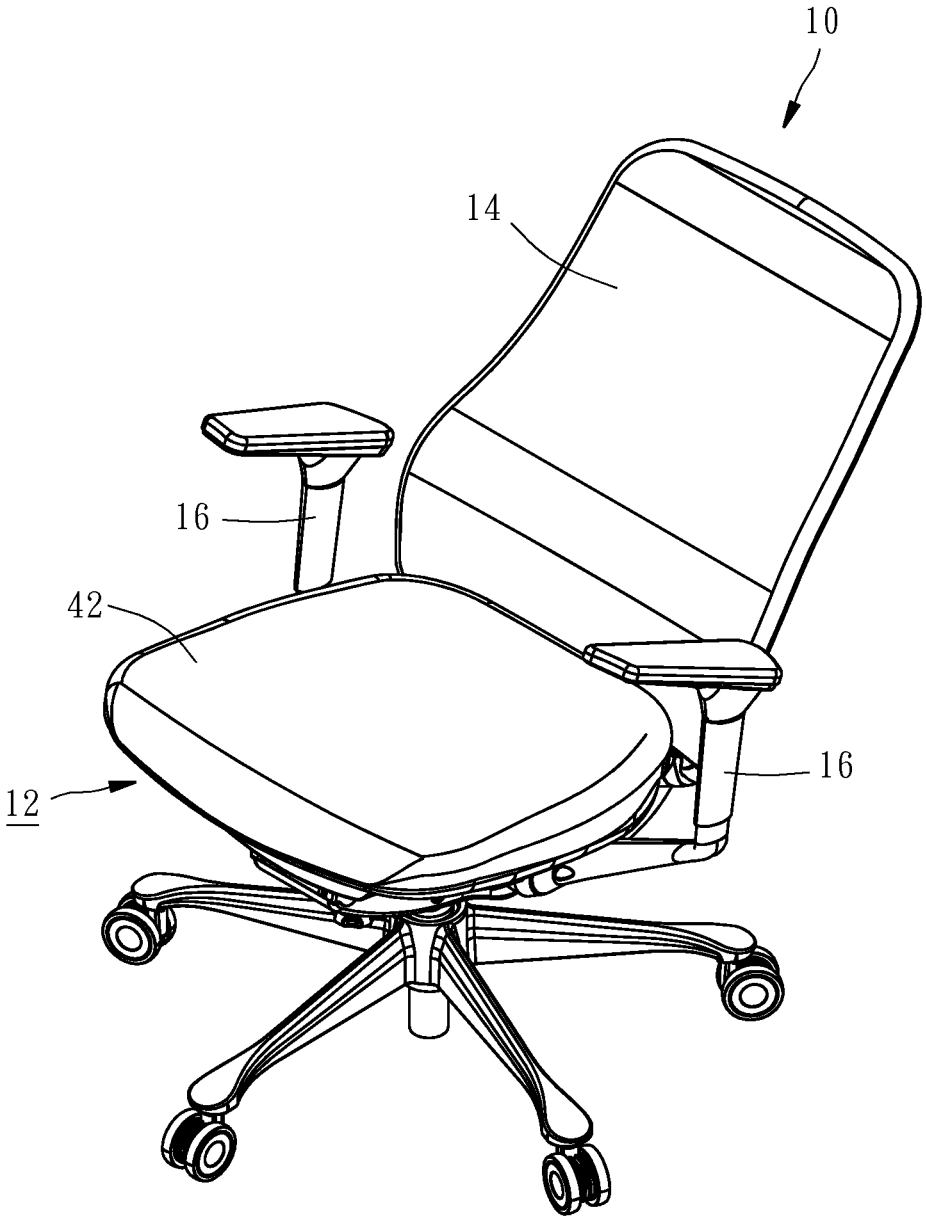
FIG. 1 is a perspective view of a chair equipped with a seat guiding apparatus in accordance with a preferred embodiment of the present invention.
Figure 2:
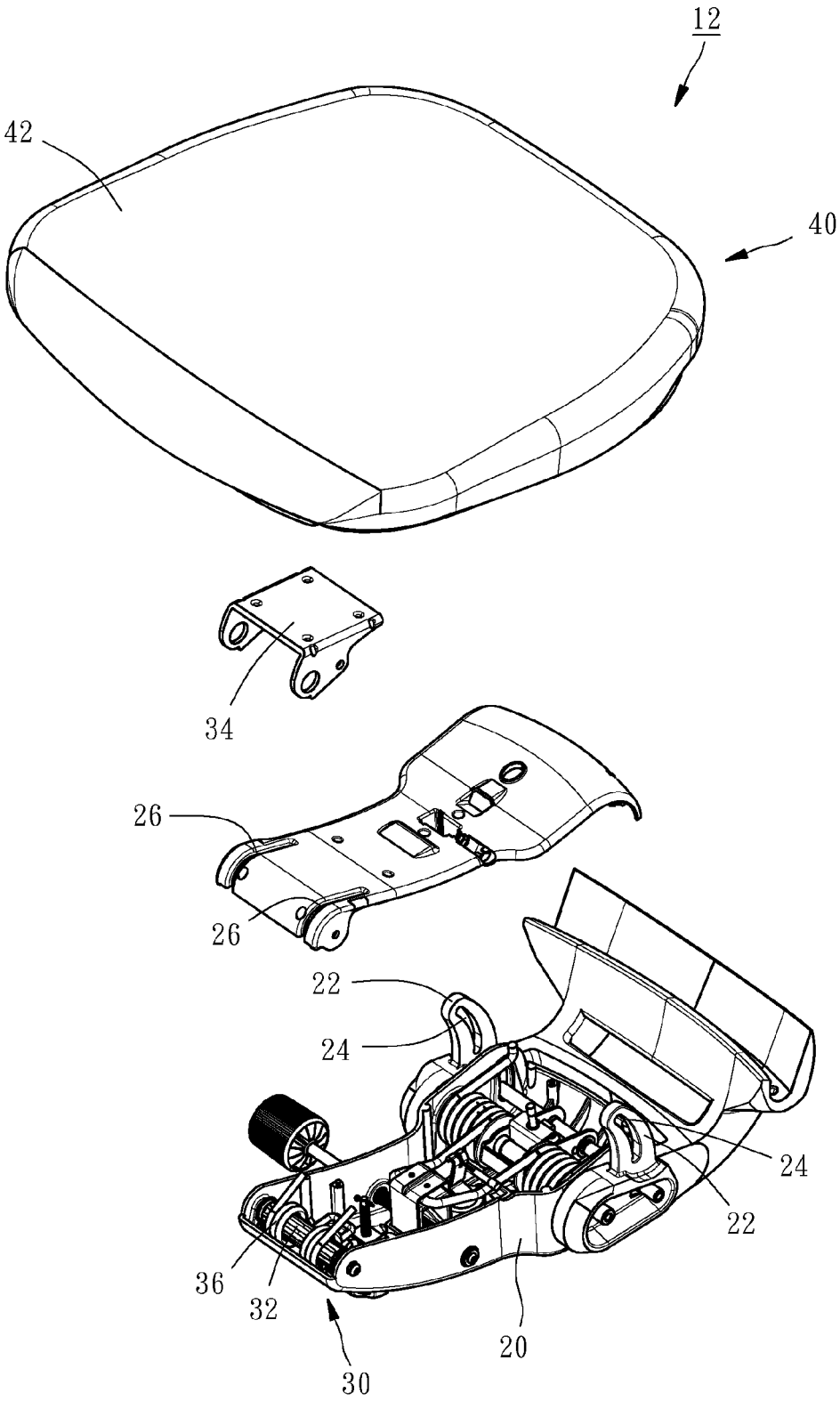
FIG. 2 is an exploded view of a part of the seat guiding apparatus in accordance with the preferred embodiment of the present invention.
Figure 3:
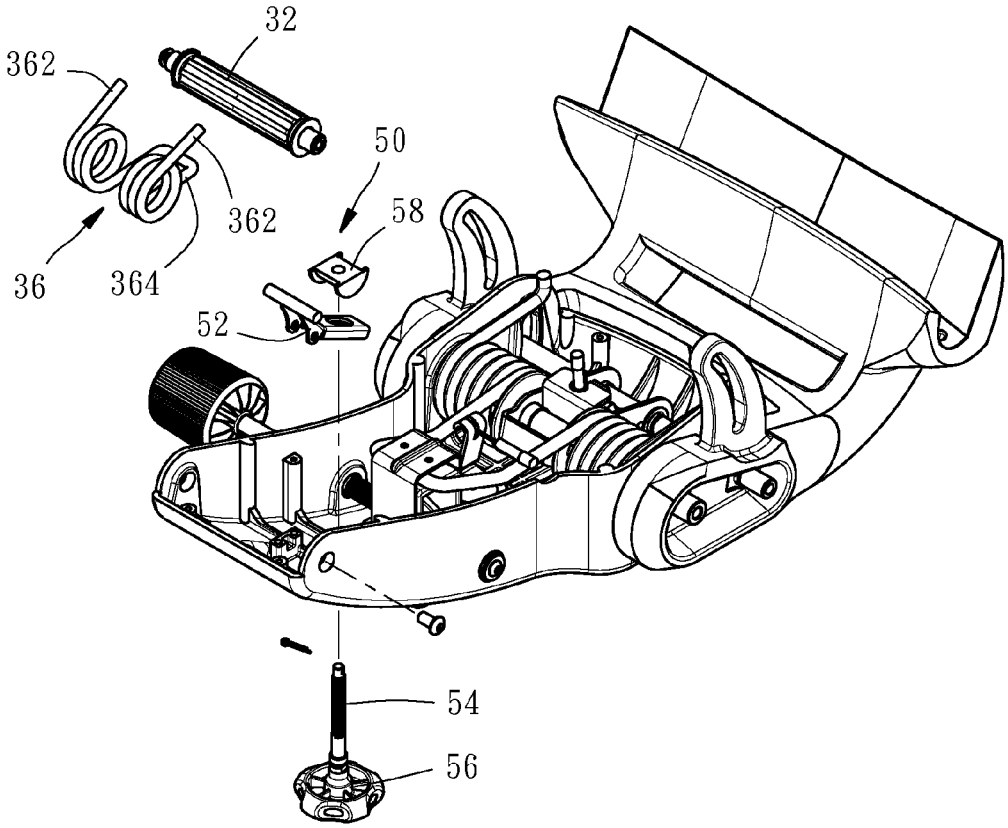
FIG. 3 is another exploded view of a part of the seat guiding apparatus in accordance with the preferred embodiment of the present invention.

Referring to FIGS. 1 and 2, a seat guiding apparatus 12 provided by a preferred embodiment of the present invention is used in a chair 10, comprising a base 20, an elastic assembly 30, and a seat assembly 40.

The base 20 has a rear end connected with a backrest 14, and left and right sides respectively connected with two armrests 16. Further, the base 20 has two guiding portions 22 near the armrests 16, each of which extends curvedly from the rear end of the base 20 toward a front end of the base 20 and has a curved guiding groove 24. Two opposite slots 26 are provided at a top of the front end of the base 20.

The elastic assembly 30 includes a shaft 32 having two ends fastened to the front end of the base 20, a moveable plate 34 pivotally mounted on the shaft 32, and a torsion spring 36 sleeved on the shaft 32 and provided with two distal ends 362 stopped against a bottom of the moveable plate 34 through the slots 26 of the base 20 for applying a rebound force to the moveable plate 34.

Figure 4:
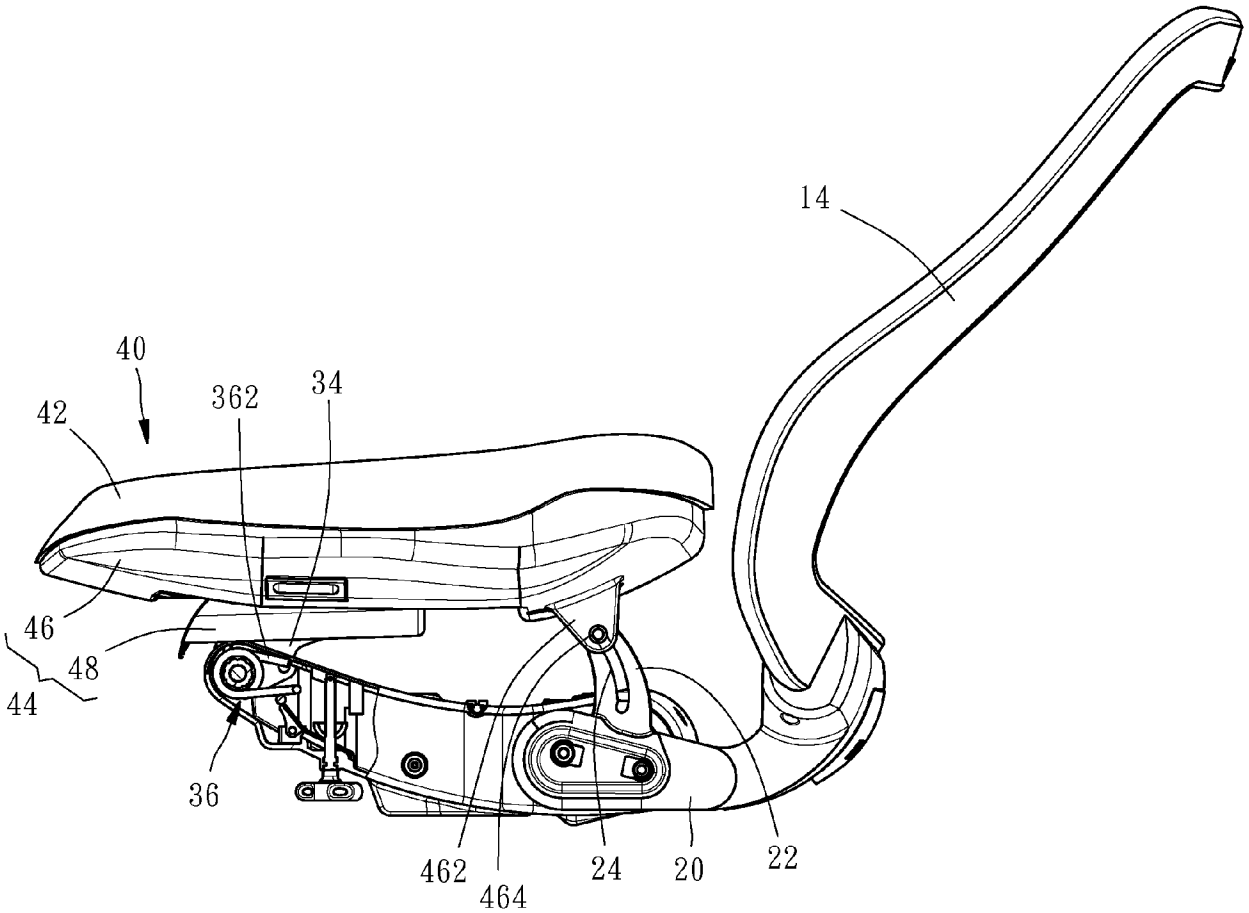
FIG. 4 is a partially cutaway lateral view of the seat guiding apparatus in accordance with the preferred embodiment of the present invention.

The seat assembly 40 includes a seat 42 and a bracket 44. As shown in FIG. 4, the bracket 44 has a first retaining plate 46 with a top side connected with the seat 42 and a second retaining plate 48 with a top side connected with a bottom side of the first retaining plate 46 and a bottom side connected with the moveable plate 34. Besides, two opposite lug portions 462 are provided at a rear end of the bottom side of the first retaining plate 46, and respectively connected with the guiding portions 22 of the base 20 through a pin 464 inserted into each of the curved guiding grooves 24.

The structure of the seat guiding apparatus 12 is described as above, and the operation of the seat guiding apparatus 12 of the present invention is outlined hereinafter.

Figure 5:
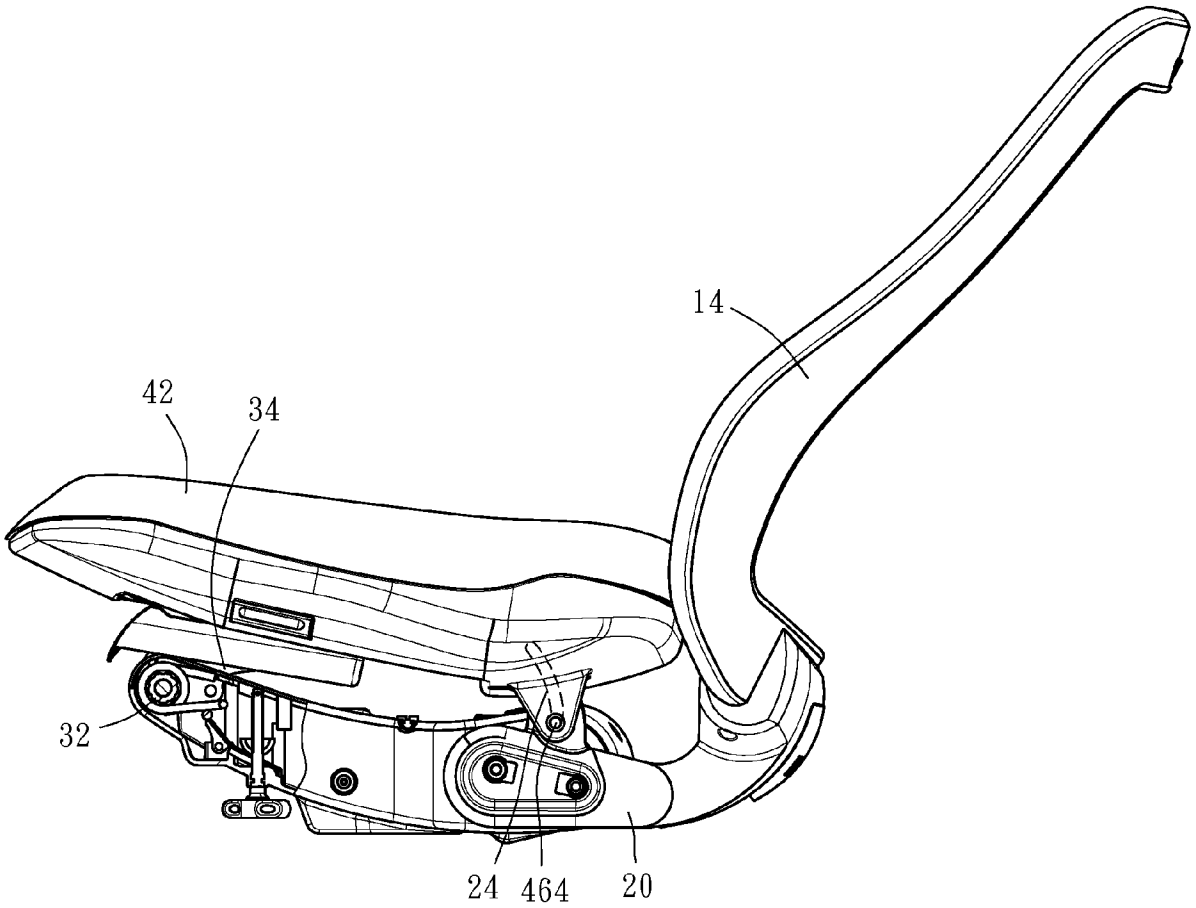
FIG. 5 is similar to FIG. 4, showing the seat assembly is moved downwards.

When a sitter sits on the seat 42, the moveable plate 34 is forced by the seat assembly 40 to turn towards the base 20, and meanwhile the pins 464 are driven by the seat assembly 40 to move downwards along the curved guiding grooves 24 of the base 20, such that the seat assembly 40 is pivoted around the shaft 32 and moved curvedly towards the backrest 14, as shown in FIGS. 4 and 5, resulting in that the sitter's back will be guided towards the backrest 14 during the movement of the seat assembly 40. When the pins 464 are stopped against the bottom end of the curved guiding grooves 24, the sitter's back will lean against the backrest 14 for support. If the sitter stands up, the seat assembly 40 will be moved upwards through an acting force applied by the torsion spring 36 to an initial position shown in FIG. 4

Figure 6:
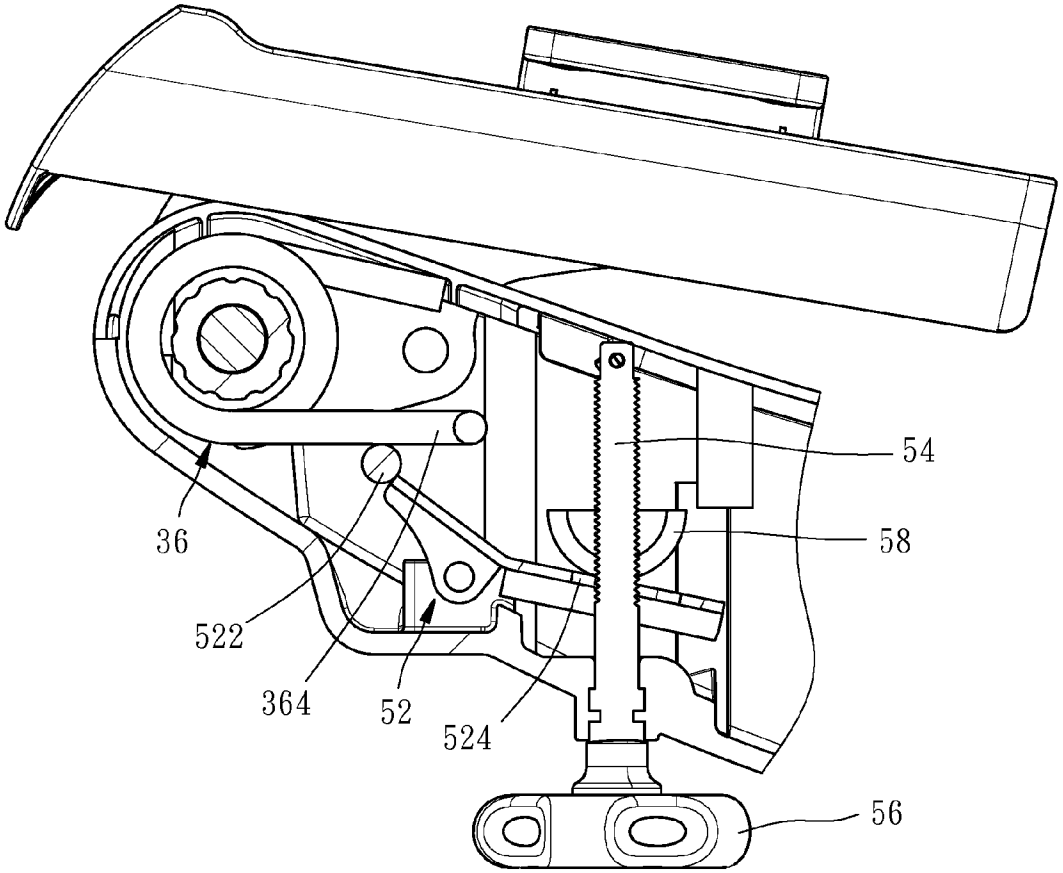
FIG. 6 is a cross-sectional view of the adjusting assembly of the seat guiding apparatus in accordance with the preferred embodiment of the present invention.

Furthermore, an elasticity adjusting assembly 50 is provided for adjusting the torsional force of the torsion spring 36 according to different sitters with different weights. As shown in FIG. 6, the elasticity adjusting assembly 50 comprises a swivel member 52 pivotally mounted in the base 20 like a seesaw and having an abutting portion 522 abutted against a U-shaped portion 364 of the torsion spring 36, a screw rod 54 rotatably inserted into the base 20 through an elongated slot 524 of the swivel member 52, a knob 56 mounted with one end of the screw rod 54 for driving the screw rod 54 to rotate, and a press block 58 screwed onto the screw rod 54 and located on the swivel member 52 so as to be driven by the screw rod 54 to press the swivel member 52.

Figure 7:
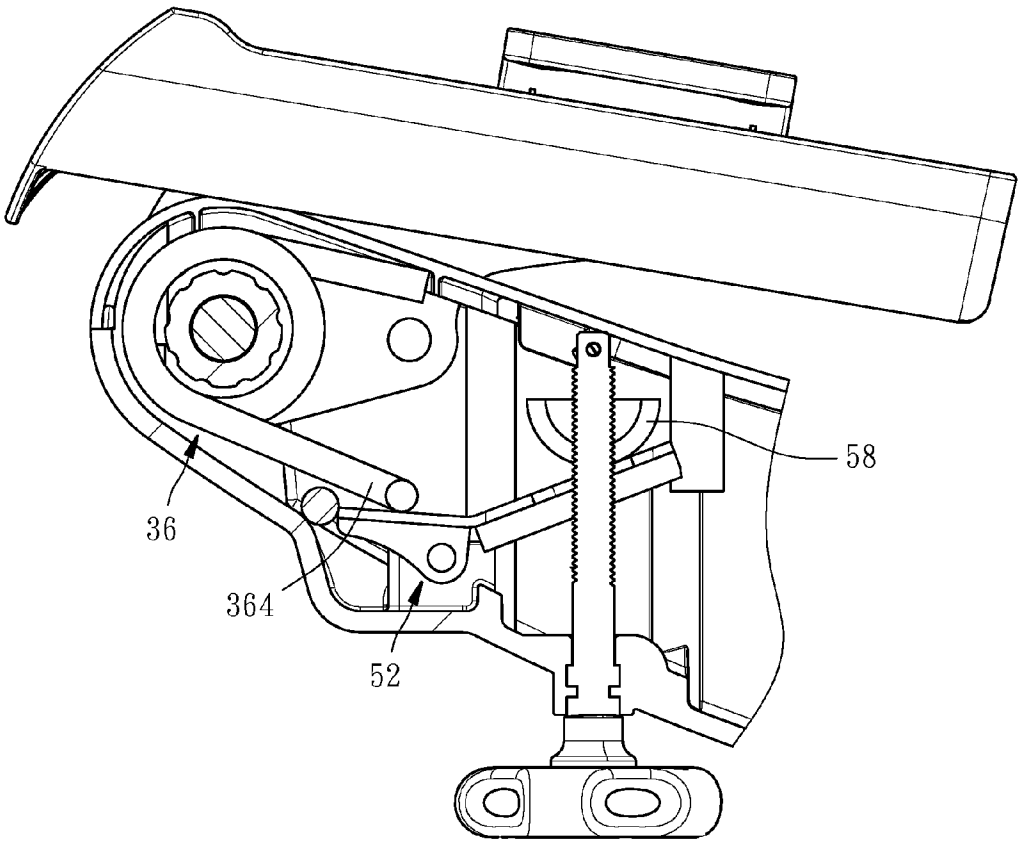
FIG. 7 is similar to FIG. 6, showing the adjusting assembly is operated.

When the knob 56 is rotated, the press block 58 is driven to move upwards and downwards relative to the swivel member 52. As shown in FIGS. 6 and 7, if the press block 58 is stopped against one end of the swivel member 52, the swivel member 52 will be pivotally moved and push the torsion spring 36 through its abutting portion 522 to tighten the torsion spring 36, thereby increasing a drag force acting on the seat assembly 40. On the contrary, if the press block 58 is moved away from the swivel member 52, the swivel member 52 is turned by a rebound force applied by the U-shaped portion 364 of the torsion spring 36 to reduce the drag force exerting on the seat assembly 40.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A seat guiding apparatus for a chair, comprising:

a base having two guiding portions at two opposite sides thereof, each of the guiding portions extending curvedly from a rear end of the base toward a front end of the base and being provided with a curved guiding groove;

an elastic assembly having a shaft fastened to the front end of the base, a moveable plate pivotally connected with the shaft, and a torsion spring mounted on the shaft and provided with two distal ends stopped against a bottom of the moveable plate;

a seat assembly having a seat and a bracket connected with a bottom of the seat, the bracket having a front end connected with the moveable plate, and a rear end provided with two opposite lug portions respectively connected with the guiding portions of the base through a pin inserted into each of the curved guiding grooves, such that the seat assembly is pivotable around the shaft and movable along the curved guiding grooves relative to the base; and an elasticity adjusting assembly including a swivel member pivotally mounted in the base and provided with an abutting portion abutted against a U-shaped portion of the torsion spring, a screw rod rotatably inserted into the base through an elongated slot of the swivel member, a knob mounted with one end of the screw rod for driving the screw rod to rotate, and a press block screwed onto the screw rod and located on the swivel member so as to be driven by the screw rod to press the swivel member.

2. The seat guiding apparatus of claim 1, wherein the bracket includes a first retaining plate having a top side connected with the seat, and a second retaining plate having a top side connected with a bottom side of the first retaining plate, and a bottom side connected with the moveable plate.

3. A seat guiding apparatus for a chair, comprising:

a base having two guiding portions at two opposite sides thereof, each of the guiding portions extending curvedly from a rear end of the base toward a front end of the base and being provided with a curved guiding groove;

an elastic assembly having a shaft fastened to the front end of the base, a moveable plate pivotally connected with the shaft, and a torsion spring mounted on the shaft and provided with two distal ends stopped against a bottom of the moveable plate; and a seat assembly having a seat and a bracket connected with a bottom of the seat, the bracket having a front end connected with the moveable plate and a rear end provided with two opposite lug portions respectively connected with the guiding portions of the base through a pin inserted into each of the curved guiding grooves, such that the seat assembly is pivotable around the shaft and movable along the curved guiding grooves relative to the base;

wherein a top side of the base has two slots for extending therefrom the distal ends of the torsion spring.

4. The seat guiding apparatus of claim 3, wherein the bracket includes a first retaining plate having a top side connected with the seat, and a second retaining plate having a top side connected with a bottom side of the first retaining plate, and a bottom side connected with the moveable plate.

* * * * *